US008891804B2

(12) United States Patent
Wei

(10) Patent No.: US 8,891,804 B2
(45) Date of Patent: Nov. 18, 2014

(54) ELECTROACOUSTIC TRANSDUCER

(75) Inventor: Suo-He Wei, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 189 days.

(21) Appl. No.: 13/190,434

(22) Filed: Jul. 25, 2011

(65) Prior Publication Data

US 2012/0155693 A1 Jun. 21, 2012

(30) Foreign Application Priority Data

Dec. 21, 2010 (CN) ..... 2010 2 0671854 U

(51) Int. Cl.
*H04R 1/00* (2006.01)
*H04R 9/06* (2006.01)
*H04R 9/10* (2006.01)

(52) U.S. Cl.
CPC .. *H04R 9/06* (2013.01); *H04R 9/10* (2013.01); *H04R 2400/03* (2013.01); *H04R 2499/11* (2013.01)
USPC ..... 381/386; 381/396

(58) Field of Classification Search
USPC ..... 381/386, 396, 394, 151
See application file for complete search history.

(56) References Cited

U.S. PATENT DOCUMENTS

| | | | | |
|---|---|---|---|---|
| 2003/0202675 | A1* | 10/2003 | Ito | 381/398 |
| 2005/0018869 | A1* | 1/2005 | Ajiki et al. | 381/394 |
| 2007/0140519 | A1* | 6/2007 | Fukuyama et al. | 381/398 |
| 2007/0164616 | A1* | 7/2007 | Kuwabara et al. | 310/15 |
| 2009/0174510 | A1* | 7/2009 | Kim | 335/222 |
| 2010/0054501 | A1* | 3/2010 | Choi | 381/151 |

* cited by examiner

*Primary Examiner* — Duc Nguyen
*Assistant Examiner* — Phan Le
(74) *Attorney, Agent, or Firm* — Anova Law Group, PLLC

(57) ABSTRACT

An electroacoustic transducer is disclosed. The electroacoustic transducer includes a frame forming a hollow space, an elastic plate mounted on the frame, a vibrating member suspended in the hollow space by the elastic plate, a diaphragm arranged facing the vibrating member, a voice coil positioned on the diaphragm. The vibrating member includes a yoke defining a bottom wall, a side wall extending upwardly and perpendicularly from an outer periphery of the bottom wall, a lapel extending vertically from the side wall. A width of the lapel is greater than that of the side wall or the bottom wall.

6 Claims, 2 Drawing Sheets

ELECTROACOUSTIC TRANSDUCER

FIELD OF THE INVENTION

The present invention relates to the art of electroacoustic transducers, and more specifically to an electroacoustic transducer used in a portable device, such as a mobile phone.

DESCRIPTION OF RELATED ART

A typical electroacoustic transducer has only one simple function. Inputted electric energy causes the sound coil and a magnet of the electroacoustic transducer to produce a coupling effect and to further move a vibration panel. When the vibration panel is vibrated, air molecules contacting the vibration panel are excited to produce a variable dense-disperse wave (longitudinal wave). The amount of variation of the dense-disperse wave is the waveform of sound pressure audible to human ears.

The electroacoustic transducer can only produce a magnetic loop to convert electric energy into sound energy without any other added functions. Therefore, while installed in an electronic telecommunication apparatus (for example, a cellular phone), two component parts are required to achieve sound producing and vibration functions. In recent years, it has been the market tendency to make electronic apparatus thinner and smaller and to provide electronic telecommunication apparatus with user-friendly operation interfaces. The vibrating member needs sufficient vibration amplitude for ensuring good performance. However, as mentioned above, the transducer is designed smaller and thinner, no extra space is provided for the vibrating member to vibrate with sufficient amplitude. As the vibration amplitude is restricted, sound performance of the transducer cannot satisfy the requirements.

So, it is necessary to provide a new transducer for solving the problem mentioned above.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments.

DETAILED DESCRIPTION OF THE EMBODIMENT

Reference will now be made to describe the exemplary embodiment of the present invention in detail.

Figure 1:
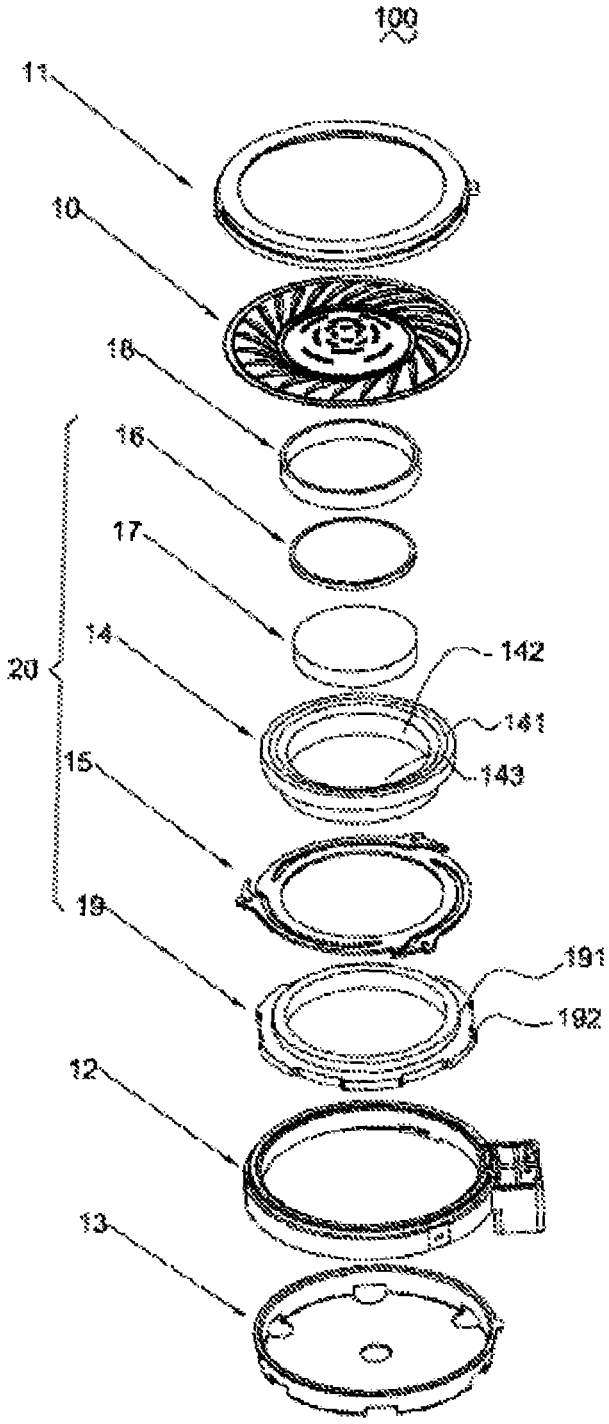
FIG. 1 is an isometric exploded view of an electroacoustic transducer in accordance with an exemplary embodiment of the present invention.
Figure 2:
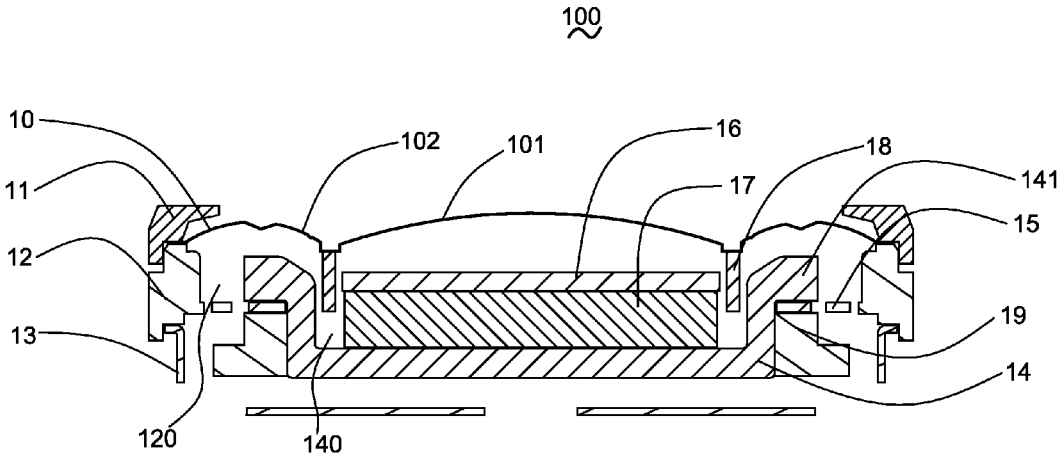
FIG. 2 is an illustrative cross-sectional view of the electroacoustic transducer in FIG. 1.
Figure 3:
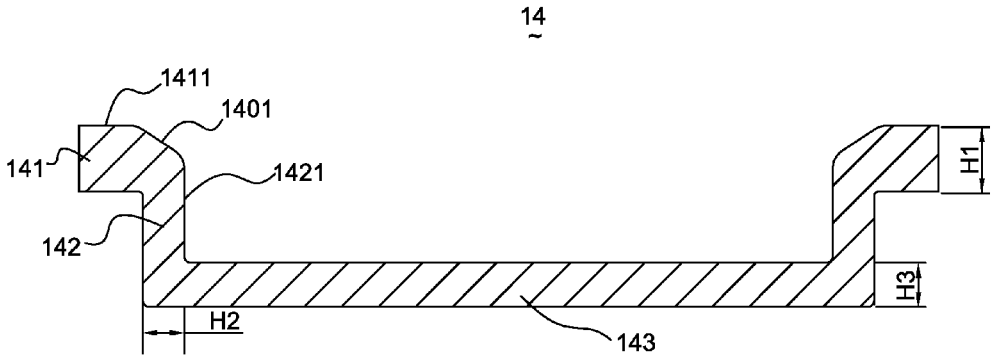
FIG. 3 is an illustrative cross-sectional view of a yoke of the electroacoustic transducer in FIG. 1.

Referring to FIG. 1 through FIG. 3, an electroacoustic transducer 100 comprises a frame 12 forming a hollow space 120, an elastic plate 15 assembled with the frame 12 and suspended in the hollow space 120, a vibrating member suspended in the hollow space 120 by the elastic plate 15 and defining a magnetic gap 140, a diaphragm 10 arranged facing the vibrating member with a periphery thereof fixed to the frame 1, a voice coil 18 attached to a lower surface of the diaphragm 10 with a part thereof inserted into the magnetic gap 140 of the vibrating member 3, a case 11 covering the diaphragm 10 and attached to the frame 12, and a shell 13 mounted on the other end of the frame 12 and forming a housing corporately with the frame 12.

Referring to FIGS. 1 and 2, the elastic plate 15 comprises a circular plane lamina and a plurality of elastic arms extending outwardly from a circumference of the circular plane lamina. The vibrating member 20 comprises a yoke 14 supported by the elastic plate 15, a magnet 17 received in the yoke 14, a pole plate 16 attached to a top surface of the magnet 17. The yoke 14 includes a bottom wall 143, a side wall 142 extending upwardly and perpendicularly from an outer periphery of the bottom wall 143, a lapel 141 extending vertically from the side wall 142 and substantially parallel to the bottom wall 143.

The vibrating member 20 further comprises a weight 19 defines an annular main body 191 and a plurality of flanges 192 extending outwardly from the main body 191. The main body 191 coupled to the side wall 142 of the yoke 14. In an alternative embodiment, the weight may be an integral part of the yoke. The elastic plate 15 is at least partially sandwiched between the annular main body 191 and the lapel 141 of the yoke 14. Therefore, the weight 19 is suspended in the hollow space 120 by the elastic plate 15. Accordingly, the vibrating member 20 is firmly assembled to the elastic plate 15.

The diaphragm 10 comprises a domed central area 101 and a margin 102 extending from the periphery of the domed central area 101 along a direction away from a centre of the domed central area 101.

Referring to FIG. 3, the side wall 142 defines an inner side surface 1421, and the lapel 141 defines an upper surface 1411. For providing more vibrating space to the diaphragm 10, an inclining surface 1401 extending downwardly from the side surface 1421 to the inner side surface 1421. In the other word, an inclining surface 1401 is oblique located between the upper surface 1411 and the side surface 1421.

For increasing the weight of the yoke 14, the lapel 141 defines a first width H1 along the vibrating direction of the vibrating member, the side wall 142 defines a second width H2 along a direction perpendicularly to the vibrating direction, and the bottom wall 143 defines a third width H3 along the vibrating direction. The first width H1 is greater than the second width H2 or the third width H3. Another words, a width of the lapel 141 is greater than that of the side wall 142 or the bottom wall 143.

The present invention meets the electronic telecommunication apparatus's current design focus, which is characterized in being thinner, smaller, and shorter, and greatly reducing material cost and assembly cost.

While the present invention has been described with reference to the specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. An electroacoustic transducer, comprising:

a frame forming a hollow space;

an elastic plate assembled with the frame;

a vibrating member suspended in the hollow space by the elastic plate, the vibrating member defining a yoke, a magnet received in the yoke and forming a magnetic gap together with the yoke, the yoke defining a bottom wall, a side wall extending upwardly and perpendicularly from an outer periphery of the bottom wall, and a lapel extending vertically from the side wall and substantially parallel to the bottom wall, a width of the lapel is greater than that of the side wall or the bottom wall, the side wall of the yoke further defining an inner side surface, the lapel of the yoke further defining an upper surface, an inclining surface extending from the inner side surface to the upper surface of the lapel for providing sufficient vibrating space to the diaphragm; the vibrating member further defining a weight defining an annular main body and a plurality of flanges extending outwardly from the main body; the elastic plate at least partially sandwiched between the annular main body and the lapel of the yoke;

a diaphragm arranged facing the vibrating member and attached to the frame;

a voice coil activating the diaphragm, partially inserted into the magnetic gap; and a shell mounted on the frame and form a housing corporately with the frame.

2. The electroacoustic transducer as described in claim 1, wherein elastic plate defines a circular plane lamina and a plurality of elastic arms extending outwardly from a circumference of the circular plane lamina.

3. The electroacoustic transducer as described in claim 1, wherein a case covering the diaphragm and attached to the frame.

4. An electroacoustic transducer, comprising:

a yoke defining a bottom wall, a side wall extending vertically from the bottom wall, and a lapel extending perpendicularly from the side wall;

a magnet located on the bottom wall of the yoke; a plate attached to an upper surface of the magnet; a diaphragm located above the magnet;

a voice coil attached below the diaphragm;

wherein the yoke defines a first surface as a first outline close to the diaphragm, and a second surface as a second outline opposed to the first surface, and a vertical distance from the first surface to the second surface in the lapel is greater than that in the side wall, the first surface defining a first part as an upper surface of the lapel of the yoke, a second part as an inner surface of the side wall, and a third part obliquely connecting the first and second parts for providing sufficient vibrating space to the diaphragm; and wherein the vertical distance from the first surface to the second surface in the lapel is greater than that in the bottom wall.

5. An electroacoustic transducer, comprising:

a housing forming a hollow space;

an elastic plate assembled with the frame;

a yoke suspended in the hollow space by the elastic plate, a magnet received in the yoke and forming a magnetic gap together with the yoke, a weight coupled to the yoke, the yoke defining a bottom wall, a side wall extending upwardly and perpendicularly from an outer periphery of the bottom wall, and a lapel extending vertically from the side wall and substantially parallel to the bottom wall, a width of the lapel is greater than that of the side wall or the bottom wall, the side wall defining an inner side surface, the lapel of the yoke defining an upper surface, and the inner side surface connected to the upper surface by an inclining surface for providing sufficient vibrating space to the diaphragm;

the elastic plate at least partially sandwiched between the weight and the lapel of the yoke;

a diaphragm arranged facing the yoke and attached to the frame;

a voice coil attaching to the diaphragm and partially inserted into the magnetic gap; a case covering the diaphragm and attached to the housing;

and wherein the weight defines an annular main body and a plurality of flanges extending outwardly from the main body.

6. The electroacoustic transducer as described in claim 5, wherein the elastic plate defines a circular plane lamina and a plurality of elastic arms extending outwardly from a circumference of the circular plane lamina.

* * * * *